US012173421B2

(12) United States Patent
Nunomura

(10) Patent No.: US 12,173,421 B2
(45) Date of Patent: Dec. 24, 2024

(54) ALUMINUM MEMBER AND METHOD OF MANUFACTURING ALUMINUM MEMBER

(71) Applicant: UACJ CORPORATION, Tokyo (JP)

(72) Inventor: Junji Nunomura, Tokyo (JP)

(73) Assignee: UACI CORPORATION, Tokyo (JP)

( * ) Notice: Subject to any disclaimer, the term of this patent is extended or adjusted under 35 U.S.C. 154(b) by 447 days.

(21) Appl. No.: 17/382,224

(22) Filed: Jul. 21, 2021

(65) Prior Publication Data

US 2021/0348293 A1 Nov. 11, 2021

Related U.S. Application Data

(63) Continuation of application No. PCT/JP2019/046989, filed on Dec. 2, 2019.

(30) Foreign Application Priority Data

Jan. 23, 2019 (JP) ..... 2019-008875

(51) Int. Cl.
*C25D 11/04* (2006.01)
*C25D 11/08* (2006.01)

(52) U.S. Cl.
CPC ..... *C25D 11/04* (2013.01); *C25D 11/08* (2013.01)

(58) Field of Classification Search
None
See application file for complete search history.

(56) References Cited

U.S. PATENT DOCUMENTS

| | | | |
|---|---|---|---|
| 10,844,506 | B2 | 11/2020 | Nunomura |
| 2013/0094089 | A1 | 4/2013 | Isurugi et al. |
| 2013/0164555 | A1 | 6/2013 | Ding |
| 2017/0137956 | A1 | 5/2017 | Seki et al. |
| 2021/0002783 | A1 | 1/2021 | Kikuchi et al. |

FOREIGN PATENT DOCUMENTS

| | | | |
|---|---|---|---|
| CN | 101104945 | A | 1/2008 |
| CN | 101521145 | A | 9/2009 |
| CN | 102859048 | A | 1/2013 |
| CN | 103173834 | A | 6/2013 |
| CN | 106133205 | A | 11/2016 |
| JP | S60197897 | A | 10/1985 |

(Continued)

OTHER PUBLICATIONS

[English Translation] Decision to Grant a Patent dated Sep. 2, 2019 for JP Application No. 2019-008875.

(Continued)

*Primary Examiner* — Chinessa T. Golden
(74) *Attorney, Agent, or Firm* — Dorsey & Whitney LLP

(57) ABSTRACT

Provided is an aluminum member including a base material containing aluminum or an aluminum alloy and an anodic oxide film having a barrier layer on the surface of the base material and a porous layer on the barrier layer, in which the anodic oxide film has a thickness of 100 μm or less, the porous layer contains S and P, the concentration of S, $C_S$, and the concentration of P, $C_P$, in the porous layer, measured by X-ray photoelectron spectroscopy, satisfy $C_S > C_P$ over the depth direction from the surface of the anodic oxide film toward the base material.

8 Claims, 3 Drawing Sheets

(56) References Cited

FOREIGN PATENT DOCUMENTS

| | | | |
|---|---|---|---|
| JP | 2000226694 | A | 8/2000 |
| JP | 2011157624 | A | 8/2011 |
| JP | 2017025384 | A | 2/2017 |
| JP | 2017075383 | A | 4/2017 |
| JP | 2017122267 | A | 7/2017 |
| JP | 6584604 | B1 | 9/2019 |
| JP | 6584626 | B | 10/2019 |
| JP | 2019173100 | A | 10/2019 |

OTHER PUBLICATIONS

[English Translation] International Preliminary Report on Patentability Chapter I mailed Aug. 5, 2021 for PCT/JP2019/046989.
[English Translation] International Search Report and Written Opinion dated Jan. 7, 2020 for PCT/JP2019/046989.
[English Translation] Notice of Reasons for Refusal dated Jul. 1, 2019 for JP Application No. 2019-008875.
Shoshan, T. A. et al., "Interface strength and degradation of adhesively bonded porous aluminum oxides", npj Materials Degradation, Aug. 21, 2017, 8 pages.
Shoshan, T. A. et al., "XPS Analysis ofthe Surface Chemistry and Interfacial Bonding of Barrier-Type Cr (VI)-Free Anodic Oxides", The Journal of PhysicalChemistry,vol. 119, Jul. 31, 2015, pp. 19967-19975.
[English Translation] Request for the Submission of an Opinion dated Jul. 6, 2022 for the Korean Patent Application No. 10-2021-7022323.
Abrahami, Shoshan T., et al., "Interface strength and degradation of adhesively bonded porous aluminum oxides", npj Materials Degradation; www.nature.com/npjmatdeg, Aug. 21, 2017, 8 pages.
(Partial English Translation) Written Decision on Registration dated Jan. 3, 2023 in KR application No. 10-2021-7022323; pp. all.
First Office Action mailed May 15, 2024 in CN Application No. 201980090029.4; pp. all.

ALUMINUM MEMBER AND METHOD OF MANUFACTURING ALUMINUM MEMBER

CROSS REFERENCE TO RELATED APPLICATIONS

The present application is a continuation application of International Patent Application No. PCT/JP2019/046989 filed on Dec. 2, 2019, which claims the benefit of Japanese Patent Application No. 2019-008875, filed on Jan. 23, 2019. The contents of these applications are incorporated herein by reference in their entirety.

BACKGROUND

Technical Field

The present disclosure relates to an aluminum member and a method of manufacturing the aluminum member.

Description of the Related Art

An aluminum member having an opaque white color has been conventionally desired so as to have excellent designability in applications such as building materials, and housings for electronic devices. However, the opaque white color is a color tone that is difficult to achieve by general dying and coloring methods which are used in anodic oxidation treatments on aluminum members. Accordingly, methods of manufacturing an aluminum member having an opaque white color have been proposed.

Japanese Patent Application Laid-Open No. 2000-226694 discloses a method of manufacturing an aluminum member having a milky white color by performing immersion of aluminum in a phosphoric acid solution or a sulfuric acid solution for which temperature/concentration conditions are controlled in predetermined ranges, and performing electrodeposition coating after washing aluminum with water.

Japanese Patent Application Laid-Open No. 2017-25384 discloses a method of coloring an aluminum member including: forming an anodic oxide film having micropores on the surface of an aluminum molded body; and coloring the surface of the aluminum molded body by immersing the obtained aluminum molded body in an aqueous solution of a metal salt, and applying an alternating current in the aqueous solution to deposit/fill a pigment in the formed micropores.

SUMMARY

However, in the conventional methods of manufacturing an aluminum member having an opaque white color, a complicated electrolysis step has been necessary in some cases, where a treatment step of a secondary or higher treatment has been necessary. In addition, by the conventional methods of manufacturing an aluminum member, an aluminum member having sufficient whiteness has not been obtained yet.

The present inventor, as a result of diligent studies to solve the above problems, found that when a porous layer contains sulfur (S) and phosphorus (P), and in the depth direction of an anodic oxide film, the concentration of S, $C_S$, and the concentration of P, $C_P$, in the porous layer, measured by X-ray photoelectron spectroscopy, satisfy $C_S>C_P$, the whiteness of an aluminum member can thereby be enhanced, and has completed the present disclosure.

Further, the present inventor has found that when an anodic oxidation treatment on an aluminum member is performed using an electrolytic solution having a particular composition, an aluminum member having high whiteness is thereby obtained by a simple primary treatment, and has completed the present disclosure.

The present disclosure has the following embodiments.

[1] An aluminum member including:

a base material containing aluminum or an aluminum alloy; and an anodic oxide film having a barrier layer on a surface of the base material and a porous layer on the barrier layer, wherein the anodic oxide film has a thickness of 100 μm or less, the porous layer contains S and P, and a concentration of S, $C_S$, and a concentration of P, $C_P$, in the porous layer, measured by X-ray photoelectron spectroscopy, satisfy $C_S>C_P$.

[2] The aluminum member according to [1], wherein when in a depth direction from a surface of the anodic oxide film toward the base material, a region having a depth greater than 500 nm from a surface of the porous layer is defined as S1, and a region having a depth of 500 nm or less from the surface of the porous layer is defined as S2, an existing amount of a sulfide based on 2p orbital electrons in the region S1 measured by X-ray photoelectron spectroscopy, S1(2p), and an existing amount of the sulfid based on 2p orbital electrons in the region S2 measured by X-ray photoelectron spectroscopy, S2(2p), satisfy a relationship of $$S1(2p)/S2(2p)=0.5 \text{ to } 100.$$

[3] The aluminum member according to [1], wherein a peak of a spectrum based on 2p orbital electrons of S in a binding energy of 155 to 165 eV measured by X-ray photoelectron spectroscopy, exists in the porous layer in a range of a depth of 0.50 to 100 μm from a surface of the porous layer in a depth direction from a surface of the anodic oxide film toward the base material.

[4] A method of manufacturing the aluminum member according to [1], including:

preparing a base material containing aluminum or an aluminum alloy; and performing an anodic oxidation treatment on the base material in an electrolytic solution containing (a) a first acid containing S or a salt of the first acid, and (b) at least one second acid selected from the group consisting of diphosphoric acid, triphosphoric acid, and polyphosphoric acid, or a salt of the second acid.

[5] The method of manufacturing the aluminum member according to [4], wherein in performing the anodic oxidation treatment, a concentration of the first acid or the salt of the first acid in the electrolytic solution is 0.01 to 2.0 $mol \cdot dm^{-3}$, and a concentration of the second acid or the salt of the second acid in the electrolytic solution is 0.01 to 5.0 $mol \cdot dm^{-3}$.

[6] The method of manufacturing the aluminum member according to [4], wherein in performing the anodic oxidation treatment, the anodic oxidation treatment is performed under conditions of a current density of 5 to 30 $mA \cdot cm^{-2}$ and an electrolysis time of 10 to 600 minutes.

An aluminum member having high whiteness can be provided by a simple primary treatment.

DETAILED DESCRIPTION

1. Aluminum Member

Figure 1:
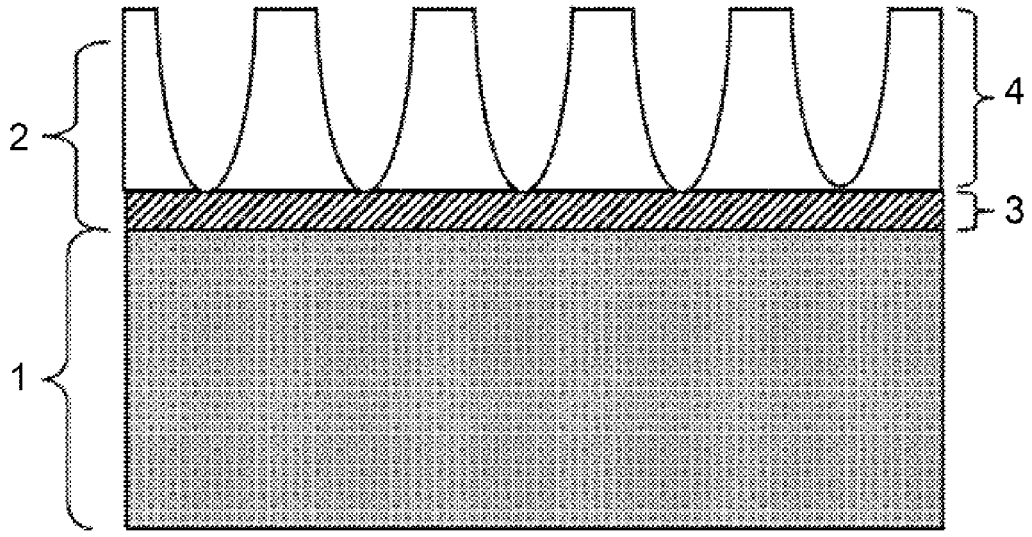
FIG. 1 is a diagram schematically showing an aluminum member of one embodiment.

An aluminum member includes a base material, and an anodic oxide film on the surface of the base material, and the anodic oxide film has a barrier layer on the surface of the base material, and a porous layer on the barrier layer. The anodic oxide film has the barrier layer and the porous layer in order from the surface of the base material toward the surface of the anodic oxide film. Hereinafter, each part that forms the aluminum member of one embodiment will be described.

(Base Material)

The base material may be made of aluminum, or may be made of an aluminum alloy. The material of the base material can appropriately be selected according to the applications of the aluminum member. For example, it is preferable that 5000 series aluminum alloy or 6000 series aluminum alloy is used as the base material from the viewpoint of enhancing the strength of the aluminum member. In addition, it is preferable that 1000 series aluminum alloy or 6000 series aluminum alloy in which coloration due to the anodic oxidation treatment is unlikely to occur is used as the base material from the viewpoint of enhancing the whiteness after the anodic oxidation treatment furthermore.

(Anodic Oxide Film)

The anodic oxide film has a barrier layer formed on the surface of the base material, and a porous layer formed on the barrier layer. The porous layer contains P (phosphorus atoms) and S (sulfur atoms), and the anodic oxide film has a thickness of 100 μm or less. In addition, the concentration of S, $C_S$, and the concentration of P, $C_P$, in the porous layer satisfies $C_S>C_P$ over the whole of the depth direction from the surface of the anodic oxide film toward the base material. Note that these S and P are measured by X-ray photoelectron spectroscopy (XPS). The XPS is sometimes called ESCA (Electron Spectroscopy for Chemical Analysis). XPS can analyze the composition and the chemical binding states of elements that form the surface of a sample by measuring the kinetic energy of photoelectrons to be emitted from the surface of the sample when the surface of the sample is irradiated with an X-ray. By XPS, all the elements excluding H and He can be detected, and the information on the outermost surface of the anodic oxide film with a resolution of about 10 nm in depth can be obtained. In addition, by combining sputtering of argon or the like and an analytical technique by use of XPS, analysis of the composition and the chemical binding states of elements along the depth direction can also be performed.

More specifically, qualitative analysis and quantitative analysis can be performed for composition analysis of the elements that form the surface of a sample by using a method of detecting the elements with high sensitivity by scanning the whole energy range, which is called wide scan analysis. $C_S$ and $C_P$ can be measured by the wide scan analysis. With respect to the analysis of the chemical binding states, a chemical binding state can be specified from a peak position and a peak shape of binding energy of electrons using a method of scanning a narrow energy range with high energy resolution, which is called narrow scan analysis. The chemical binding state can be specified by a shift (chemical shift) of binding energy, caused by formation of a chemical bond between a particular atom, such as S, and another atom. In the narrow scan analysis, the energy range to be scanned can be set according to the type of element, and particularly when the existing amount of S based on 2p orbital electrons is analyzed, an energy range of preferably 145 to 185 eV, more preferably 150 to 180 eV, and still more preferably 155 to 175 eV may be scanned. When the existing amount of P based on 2s orbital electrons is analyzed, an energy range of preferably 170 to 210 eV, more preferably 175 to 205 eV, and still more preferably 180 to 200 eV may be scanned. S1(2p), S2(2p), and the peak of the spectrum based on 2p orbital electrons of S in a binding energy of 155 to 165 eV can be measured by the narrow scan analysis.

It is considered that in one embodiment, S (a sulfur atom) has an action of forming a wall surface in the direction perpendicular to the surface of the base material, and P (a phosphorus atom) has a function of forming a wall surface in the direction approximately parallel to the surface of the base material when the porous layer is formed. The porous layer of one embodiment contains S and P and satisfies the relationship of $C_S>C_P$, and therefore it is considered that pores each having a wall surface that makes an acute angle with the surface of the base material are formed as a result of the synergistic action of S and P. Hereinafter, in the porous layer, a pore having a wall surface that makes an acute angle with the surface of the base material is sometimes referred to as "the second pore," and a pore having a wall surface that is in the direction approximately perpendicular to the surface of the base material is sometimes referred to as "the first pore." In the aluminum member having the second pores in the porous layer in this way, diffusion of light occurs due to irregular reflection of light incident into the porous layer, so that the whiteness of the aluminum member can be enhanced. On the other hand, when the aluminum member does not have the second pores, a film structure that irregularly reflects light is not obtained, so that the whiteness of the aluminum member is lowered, and desired whiteness is not obtained. On the other hand, in the case of a relationship of $C_S \leq C_P$, since the action of forming a wall surface in the direction approximately parallel to the surface of the base material becomes larger, it is considered that the film thickness in the direction perpendicular to the surface of the base material does not become thick, and an inverse dendritic layer that irregularly reflects visible light is hard to be formed in the porous layer. Therefore, the porous layer having the second pores in such a way as to communicate with the first pores is preferable.

When the thickness of the anodic oxide film exceeds 100 μm, the electrolysis time for forming the anodic oxide film becomes longer, so that lowering of productivity is brought about, and unevenness accompanying nonuniform growth occurs, resulting in a defective appearance. It is preferable that the thickness of the anodic oxide film is 6 to 100 μm. When the thickness of the anodic oxide film is within the range, thereby the anodic oxide film that is uniform without unevenness is obtained in the aluminum member and the aluminum member can have excellent designability. It is preferable that the thickness of the porous layer is 6 μm or more and less than 100 μm, more preferably 8 to 75 μm, and still more preferably 10 to 50 μm. When the thickness of the porous layer is within these ranges, thereby the aluminum member has a suitable opaque white color, and can have excellent designability. It is preferable that the thickness of the barrier layer is 10 to 150 nm. When the barrier layer has a thickness of 10 to 150 nm, thereby coloration due to interference is suppressed, and the whiteness can be enhanced.

FIG. 1 is an outline diagram showing an aluminum member of one embodiment. As shown in FIG. 1, an anodic oxide film 2 is formed on the surface of a base material 1 containing aluminum or an aluminum alloy. The anodic oxide film 2 has a barrier layer 3 on the surface of the base material 1 and a porous layer 4 on the barrier layer 3, and is formed of a laminated structure in which the base material 1, the barrier layer 3, and the porous layer 4 are formed in the mentioned order. Note that FIG. 1 is an outline diagram, and the pore structure of the porous layer 4 is schematically shown in FIG. 1. Accordingly, the second pores exist in the porous layer 4 in FIG. 1, but the structure of the second pores is not shown in detail in FIG. 1. In addition, the porous layer 4 may have on the side of the barrier layer 3 the first pores extending in a direction perpendicular to the surface of the barrier layer depending on the manufacturing condition. In this case, the porous layer has the first pores and the second pores in order from the barrier layer side toward the surface side of the porous layer.

Figure 2:
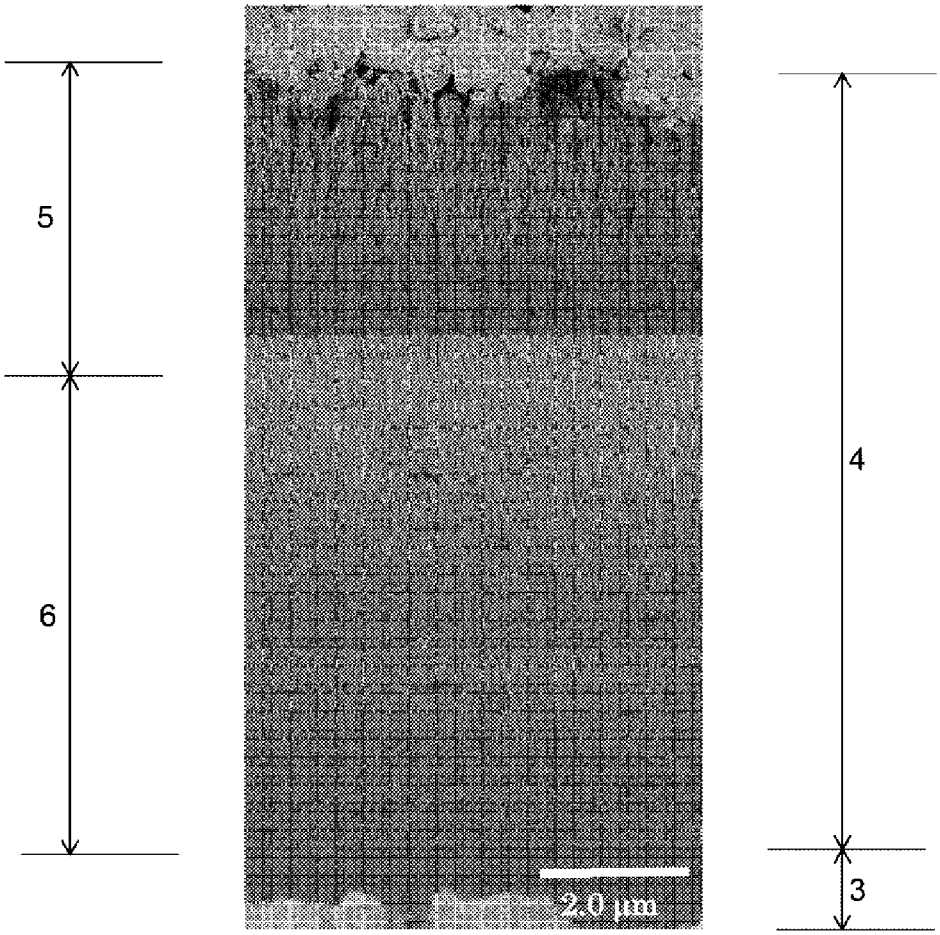
FIG. 2 is a photograph of a section of an anodic oxidation film in Example 3, the photograph having been taken with a scanning electron microscope (SEM)

FIG. 2 is a photograph of a section of an anodic oxide film in Example 3, which will be mentioned later, the photograph having been taken with a scanning electron microscope (SEM). As shown in FIG. 2, the first pores 6 extending perpendicularly to the surface of the barrier layer 3 lie on the barrier layer side of the porous layer 4. In addition, the second pores 5 extending in a direction that makes an acute angle with the surface of the base material not shown lie on the surface side of the porous layer 4. Note that the second pores 5 each exist in such a way as to communicate with each of the first pores 6. The second pores 5 take a form of inverse dendrite extending in such a way as to spread radially.

It is preferable that the Hunter whiteness as measured from the surface side of the anodic oxide film of the aluminum member is 60 to 90, more preferably 75 to 90, and still more preferably 80 to 90. Note that the Hunter whiteness means a numerical value obtained in accordance with JIS P8123. When the Hunter whiteness is larger, the whiteness is enhanced more. When the Hunter whiteness of the aluminum member is 60 to 90, thereby the aluminum member has a suitable opaque white color, and can have excellent designability.

It is preferable that when, in the depth direction from the surface of the anodic oxide film toward the base material, a region of a depth exceeding 500 nm from the surface of the porous layer is defined as S1 (a region from a depth exceeding 500 nm to a surface in contact with the surface of the barrier layer), and a region of a depth within 500 nm from the surface of the porous layer is defined as S2, the existing amount of a sulfide, based on 2p orbital electrons in the region S1 measured by X-ray photoelectron spectroscopy, S1(2p), and the existing amount of the sulfide, based on 2p orbital electrons in the region S2 measured by X-ray photoelectron spectroscopy, S2(2p), satisfy a relationship of $$S1(2p)/S2(2p)=0.5 \text{ to } 100.$$

S1(2p) and S2(2p) each are represented by a spectrum intensity of the sulfide that appears around 162 eV among the peaks obtained when the narrow scan analysis is performed. XPS can identify elements by analyzing an energy spectrum of photoelectrons to be emitted, and can analyze differences in chemical states from the shifts of the peak positions. A peak that appears around a binding energy of 162 eV can be decided to be derived from the sulfide using the data base bundled with an apparatus (PHI 5000 VersaProbe III manufactured by ULVAC-PHI, Inc.). Note that the sulfide in this case represents a sulfur compound having a valence number of 2. When S1(2p)/S2(2p)=0.5 to 100, thereby the existing amount of the sulfide in the region S1 having a depth greater than 500 nm from the surface in the porous layer is about the same as or larger than the existing amount of the sulfide in the region S2 having a depth of 500 nm or less from the surface. As a result, the first pores extending in a direction approximately perpendicular to the surface of the base material can be formed more regularly on the barrier layer side of the porous layer, and unevenness in white color can be reduced.

Note that the existing amount of the sulfide based on 2p orbital electrons is analyzed by using the narrow scan analysis in an energy range of 155 to 175 eV in XPS. By the narrow scan analysis in the energy range as described above, $SO_4$ and the sulfide are detected as S based on 2p orbital electrons in the porous layer, and a peak that appears around a binding energy of 162 eV can be decided to be derived from the sulfide. As represented by the above equation, a particular relationship exists between the existing amounts of the sulfide in the regions S1 and S2 in some cases. S1(2p) and S2(2p) more preferably satisfy a relationship of S1(2p)/S2(2p)=0.75 to 90, and still more preferably satisfy a relationship of S1(2p)/S2(2p)=1.0 to 80.

It is preferable that the peak of the spectrum based on 2p orbital electrons of S, in a binding energy of 155 to 165 eV measured by the narrow scan analysis in X-ray photoelectron spectroscopy, exists in the porous layer in a range of a depth of 0.50 to 100 μm in the depth direction from the surface of the porous layer, the peak more preferably exists in the porous layer in a range of 0.75 to 90 μm, and still more preferably exists in the porous layer in a range of 1.0 to 80 μm in the depth direction from the surface of the porous layer. When the depth of the peak of the spectrum exists in the above range, thereby the first pores extending in a perpendicular direction at the lower parts of the second pores can be formed up to a thickness that is enough to irregularly reflect visible light, and the whiteness of the aluminum member can be enhanced.

2. Method of Manufacturing Aluminum Member

A method of manufacturing an aluminum member of one embodiment includes: preparing a base material; and performing an anodic oxidation treatment on the base material. There has been conventionally a need to perform a primary treatment, and a secondary treatment using an electrolytic solution different from the primary treatment for the purpose of performing an anodic oxidation treatment. Further, there has been a need to perform third or higher treatments each using a different electrolytic solution depending on the circumstances. In contrast, by the method of manufacturing an aluminum member of one embodiment, it is possible to provide the aluminum member in which the concentration of S, $C_S$, and the concentration of P, $C_P$, in the porous layer, measured by X-ray photoelectron spectroscopy, satisfy $C_S>C_P$ over the depth direction from the surface of the anodic oxide film toward the base material. As a result, the aluminum member having high whiteness can be provided by a primary treatment that is simpler than in the past. Hereinafter, each step will be described in detail.

(Preparing Base Material)

At first, the base material containing aluminum or an aluminum alloy is prepared. Examples of the aluminum alloy include, but not particularly limited to, 1000 series aluminum alloy, 5000 series aluminum alloy, or 6000 series aluminum alloy.

(Performing Anodic Oxidation Treatment on Base Material)

The condition in the anodic oxidation treatment is set to a condition under which the anodic oxide film having a barrier layer on the surface of the base material and a porous layer on the barrier layer, and having a thickness of 100 μm or less is formed. Note that the anodic oxide film formed in this step is such that the concentration of S, $C_S$, and the concentration of P, $C_P$, in the porous layer, measured by X-ray photoelectron spectroscopy, satisfy $C_S > C_P$ over the depth direction from the surface of the anodic oxide film toward the base material. Here, by the method of manufacturing an aluminum member of one embodiment, the first and the second pores, or the second pores are formed in the porous layer. The first pores are pores that are positioned on the barrier layer side and extend in the thickness direction of the porous layer. The second pores are pores that are positioned on the surface side of the porous layer and extend in the thickness direction of the porous layer in such a way as to branch radially toward the surface of the porous layer.

If necessary, a surface treatment, such as a degreasing treatment or a polishing treatment, may be performed on the base material before the anodic oxidation treatment is performed. For example, by performing an alkaline degreasing treatment as the surface treatment, the gloss value of the anodic oxide film is lowered, and the aluminum member exhibiting a white color without gloss can be obtained. By performing a polishing treatment, such as chemical polishing, mechanical polishing, and electrolytic polishing, as the surface treatment, the gloss value of the anodic oxidation treatment is enhanced, and the aluminum member exhibiting a white color with gloss can be obtained. It is preferable to perform an electrolytic polishing treatment on the base material before the anodic oxidation treatment is performed from the viewpoint of enhancing the whiteness and the gloss value of the aluminum member more.

It is preferable to use an electrolytic solution containing a first acid containing S or a salt of the first acid, and at least one second acid selected from the group consisting of diphosphoric acid, triphosphoric acid, and polyphosphoric acid, or a salt of the second acid when the anodic oxidation treatment for obtaining the anodic oxide film as described above is performed. In addition, the first acid is more preferably an inorganic acid. The first acid or a salt of the first acid has an action of performing formation and dissolution of a film on the recessed part of the surface of the barrier layer and forming pores extending perpendicularly in the thickness direction of the film. In this way, the film grows while the aluminum base is dissolving, and therefore the anodic oxide film grows while S which is contained in the first acid is being incorporated into the anodic oxide film. Accordingly, when the chemical components in the porous layer are analyzed, S is detected.

On the other hand, the second acid selected from the group consisting of diphosphoric acid, triphosphoric acid, and polyphosphoric acid, or a salt of the second acid has an action of etching a wall surface of the recessed part, thereby forming a structure extending in the form of a fiber. In this way, a film grows while the wall surface of the anodic oxide film is being etched, and therefore the anodic oxide film grows while P which is contained in the second acid is being incorporated into the anodic oxide film. Accordingly, when the chemical components in the porous layer are analyzed, P is detected.

It is considered that in the method of manufacturing an aluminum member of one embodiment, by using the electrolytic solution containing the first acid or a salt of the first acid, and the second acid or a salt of the second acid, these substances act synergistically, and as a result, the composition distribution that satisfies $C_S > C_P$ is formed. It is considered that the porous layer having the first and the second pores, or the second pores is therefore formed.

Examples of the inorganic acid being the first acid containing S and a salt of the inorganic acid include, but not particularly limited to, at least one substance selected from the group consisting of inorganic acids, such as sulfurous acid, sulfuric acid, thiosulfuric acid, and disulfuric acid, and salts of the inorganic acids, and sulfates, such as sodium sulfate, ammonium sulfate, and sodium thiosulfate.

It is preferable to use at least one substance selected from the group consisting of diphosphoric acid, triphosphoric acid, polyphosphoric acid, and salts of diphosphoric acid, triphosphoric acid, and polyphosphoric acid as the acid anhydride being the second acid, or a salt of the acid anhydride because the second pores each having a regular shape can stably be formed.

It is preferable that the concentration of the first acid or a salt of the first acid in the electrolytic solution is 0.01 to 2.0 $mol \cdot dm^{-3}$, and more preferably 0.05 to 1.5 $mol \cdot dm^{-3}$. When the concentration of the first acid or a salt of the first acid is 0.01 $mol \cdot dm^{-3}$ or more, the anodic oxidation treatment on the base material can effectively be performed, and when the concentration of the first acid or a salt of the first acid is 2.0 $mol \cdot dm^{-3}$ or less, the dissolution power of the electrolytic solution is not enhanced, and the porous layer can effectively be grown.

It is preferable that the concentration of the second acid or a salt of the second acid in the electrolytic solution is 0.01 to 5.0 $mol \cdot dm^{-3}$, and more preferably 0.1 to 2.5 $mol \cdot dm^{-3}$. When the concentration of the second acid or a salt of the second acid is 0.01 $mol \cdot dm^{-3}$ or more, thereby the second pores can effectively be formed in the porous layer, and when the concentration of the second acid or a salt of the second acid is 5.0 $mol \cdot dm^{-3}$ or less, the second pores can periodically be formed, and the porous layer having an effective thickness can be formed. Therefore, by setting the concentration of the second acid or a salt of the second acid to 0.01 to 5.0 $mol \cdot dm^{-3}$, the porous layer can sufficiently be grown up to a certain film thickness, and the second pores can periodically be formed on the porous layer, so that the whiteness of the aluminum member can be improved.

It is preferable that the current density during the anodic oxidation treatment is 5 to 30 $mA \cdot cm^{-2}$, more preferably 5 to 20 $mA \cdot cm^{-2}$, and still more preferably 10 to 20 $mA \cdot cm^{-2}$. By setting the current density to 5 $mA \cdot cm^{-2}$ or more, the film-forming rate of the porous layer is increased, and a sufficient film thickness can be obtained. By setting the current density to 30 $mA \cdot cm^{-2}$ or less, the anodic oxidation reaction occurs uniformly, and therefore occurrence of burning and unevenness in white color can be prevented.

It is preferable that the temperature of the electrolytic solution during the anodic oxidation treatment is 0 to 80° C., and more preferably 20° C. to 60° C. When the temperature of the electrolytic solution is 0° C. or higher, the second pores each having a suitable acute angle to the surface of the base material are thereby easy to be formed, and when the temperature of the electrolytic solution is 80° C. or lower, the porous layer dissolves at a moderate rate, and therefore the film thickness becomes thick, so that the whiteness of the aluminum member can be improved.

It is preferable that the electrolysis time during the anodic oxidation treatment is 10 to 600 minutes, more preferably 30 to 300 minutes, and still more preferably 30 to 120 minutes.

TABLE 1

| | Type of alloy for base material | Surface treatment on base material | First acid or salt of first acid: Type | First acid or salt of first acid: Concentration (mol dm$^{-3}$) | Second acid or salt of second acid: Type | Second acid or salt of second acid: Concentration (mol dm$^{-3}$) | Anodic oxidation treatment condition: Temperature of electrolytic solution (° C.) | Anodic oxidation treatment condition: Current density (mA · cm$^{-2}$) | Anodic oxidation treatment condition: Retention time (minutes) |
|---|---|---|---|---|---|---|---|---|---|
| Example 1 | 1100 | Alkaline degreasing | Sulfuric acid | 0.5 | Diphosphoric acid | 0.2 | 20 | 10 | 60 |
| Example 2 | 1100 | Alkaline degreasing | Thiosulfuric acid | 0.5 | Diphosphoric acid | 0.2 | 20 | 10 | 60 |
| Example 3 | 1100 | Alkaline degreasing | Sodium sulfate | 0.5 | Diphosphoric acid | 0.2 | 20 | 10 | 60 |
| Example 4 | 1100 | Alkaline degreasing | Sulfuric acid | 0.5 | Triphosphoric acid | 0.2 | 20 | 150 | 60 |
| Example 5 | 1100 | Alkaline degreasing | Sulfuric acid | 0.5 | Polyphosphoric acid | 0.2 | 20 | 150 | 60 |
| Example 6 | 1100 | Alkaline degreasing | Sulfuric acid | 0.005 | Diphosphoric acid | 0.2 | 20 | 10 | 60 |
| Example 7 | 1100 | Alkaline degreasing | Sulfuric acid | 0.01 | Diphosphoric acid | 0.2 | 20 | 10 | 60 |
| Example 8 | 1100 | Alkaline degreasing | Sulfuric acid | 0.05 | Diphosphoric acid | 0.2 | 20 | 10 | 60 |
| Example 9 | 1100 | Alkaline degreasing | Sulfuric acid | 1.5 | Diphosphoric acid | 0.2 | 20 | 10 | 60 |
| Example 10 | 1100 | Alkaline degreasing | Sulfuric acid | 2 | Diphosphoric acid | 0.2 | 20 | 10 | 60 |
| Example 11 | 1100 | Alkaline degreasing | Sulfuric acid | 7 | Diphosphoric acid | 0.2 | 20 | 10 | 60 |
| Example 12 | 1100 | Alkaline degreasing | Sulfuric acid | 0.5 | Diphosphoric acid | 0.005 | 20 | 10 | 60 |
| Example 13 | 1100 | Alkaline degreasing | Sulfuric acid | 0.5 | Diphosphoric acid | 0.01 | 20 | 10 | 60 |
| Example 14 | 1100 | Alkaline degreasing | Sulfuric acid | 0.5 | Diphosphoric acid | 0.1 | 20 | 10 | 60 |
| Example 15 | 1100 | Alkaline degreasing | Sulfuric acid | 0.5 | Diphosphoric acid | 2.5 | 20 | 10 | 60 |
| Example 16 | 1100 | Alkaline degreasing | Sulfuric acid | 0.5 | Diphosphoric acid | 5 | 20 | 10 | 60 |
| Example 17 | 1100 | Alkaline degreasing | Sulfuric acid | 0.5 | Diphosphoric acid | 10 | 20 | 10 | 60 |
| Example 18 | 1100 | Alkaline degreasing | Sulfuric acid | 0.5 | Diphosphoric acid | 0.2 | 0 | 10 | 60 |
| Example 19 | 1100 | Alkaline degreasing | Sulfuric acid | 0.5 | Diphosphoric acid | 0.2 | 40 | 10 | 60 |
| Example 20 | 1100 | Alkaline degreasing | Sulfuric acid | 0.5 | Diphosphoric acid | 0.2 | 60 | 10 | 60 |
| Example 21 | 1100 | Alkaline degreasing | Sulfuric acid | 0.5 | Diphosphoric acid | 0.2 | 80 | 10 | 60 |
| Example 22 | 1100 | Alkaline degreasing | Sulfuric acid | 0.5 | Diphosphoric acid | 0.2 | 20 | 2 | 60 |
| Example 23 | 1100 | Alkaline degreasing | Sulfuric acid | 0.5 | Diphosphoric acid | 0.2 | 20 | 5 | 60 |
| Example 24 | 1100 | Alkaline degreasing | Sulfuric acid | 0.5 | Diphosphoric acid | 0.2 | 20 | 20 | 60 |
| Example 25 | 1100 | Alkaline degreasing | Sulfuric acid | 0.5 | Diphosphoric acid | 0.2 | 20 | 30 | 60 |
| Example 26 | 1100 | Alkaline degreasing | Sulfuric acid | 0.5 | Diphosphoric acid | 0.2 | 20 | 50 | 60 |
| Example 27 | 6063 | Alkaline degreasing | Sulfuric acid | 0.5 | Diphosphoric acid | 0.2 | 20 | 10 | 60 |
| Example 28 | 1100 | Alkaline degreasing | Sulfuric acid | 0.5 | Diphosphoric acid | 0.2 | 20 | 10 | 10 |
| Example 29 | 1100 | Alkaline degreasing | Sulfuric acid | 0.5 | Diphosphoric acid | 0.2 | 20 | 10 | 30 |
| Example 30 | 1100 | Alkaline degreasing | Sulfuric acid | 0.5 | Diphosphoric acid | 0.2 | 20 | 10 | 120 |
| Example 31 | 1100 | Alkaline degreasing | Sulfuric acid | 0.5 | Diphosphoric acid | 0.2 | 20 | 10 | 600 |
| Example 32 | 1100 | Alkaline degreasing | Sulfuric acid | 0.5 | Diphosphoric acid | 0.2 | 20 | 10 | 700 |
| Comparative Example 1 | 1100 | Alkaline degreasing | Sulfuric acid | 0.5 | Diphosphoric acid | 0.2 | 20 | 10 | 0 |
| Comparative Example 2 | 1100 | Alkaline degreasing | — | — | Diphosphoric acid | 0.2 | 20 | 10 | 60 |
| Comparative Example 3 | 1100 | Alkaline degreasing | Sulfuric acid | 1.5 | — | — | 20 | 10 | 60 |

When the electrolysis time is 10 minutes or more, the anodic oxide film can be formed into an effective thickness of 100 μm or less, and when the electrolysis time is 600 minutes or less, production efficiency is enhanced. Note that if necessary, a post-treatment, such as a sealing treatment, may be performed after the anodic oxidation treatment is performed on the base material.

EXAMPLES

Hereinafter, the present disclosure will be described in detail based on Examples. Note that the present disclosure is not limited to the Examples shown below, and the constituent of the present disclosure can appropriately be modified in a range not impairing the gist of the present disclosure.

Under the conditions shown in Table 1 below, base materials each containing an aluminum alloy were prepared, and an anodic oxidation was then performed, thereby manufacturing aluminum members of Examples 1 to 32 and Comparative Examples 1 to 3. The conditions for manufacturing the aluminum members are shown in Table 1 below.

Measurement of respective items was performed for the aluminum members of Examples 1 to 32 and Comparative Examples 1 to 3 after that, and evaluations of the measurement results were then performed. These measurement and evaluation results are shown in Table 2. Note that the Hunter whiteness, the unevenness in white color, the ascertainment of the first and the second pores, the concentrations of S and P in the porous layer of the aluminum members, S1(2p)/S2(2p), and the depth of the spectrum peak of S 2p orbital electrons from the surface of the anodic oxide film were measured as follows. With respect to "Determination" in Table 2, when the second pores existed, the unevenness in white color was "Δ," and the Hunter whiteness was 60 or more, the "Determination" was made as "Δ," when the second pores existed, the unevenness in white color was "○," and the Hunter whiteness was 60 or more, the "Determination" was made as "○," when the second pores existed, the unevenness in white color was "◎," and the Hunter whiteness was 60 or more, the "Determination" was made as "◎," and in other cases, the "Determination" was made as "x."

<Hunter Whiteness>

L*a*b* specified in JIS Z8781-4:2013 and standardized in the International Commission on Illumination (CIE) were measured with a colorimeter (Colour Meter CC-iS: manufactured by Suga Test Instruments Co., Ltd.), and evaluated using Hunter whiteness to which L*a*b* were converted by the following equation.

$$\text{Hunter whiteness}=100-\{(100-L^*)^2+a^{*2}+b^{*2}\}^{1/2}$$

<Unevenness in White Color>

The appearances of the samples after the anodic oxidation treatments were observed visually, and when a sample was anodically oxidized in a uniform manner, the sample was evaluated as "◎," when the extent of the unevenness in white color was moderate, the sample was evaluated as "○," when the extent of the unevenness in white color was low, the sample was evaluated as "Δ," and when a lot of unevenness in white color occurred, or a sample was not anodically oxidized, the sample was evaluated as "x."

<Ascertainment of First and Second Pores>

With respect to whether or not the first pores and the second pores existed in the porous layer, measurement was performed utilizing results of observing the surface and the section of each anodic oxide film using FE-SEM (SU-8230: manufactured by Hitachi, Ltd.). The observation of the section was performed with inclination against a crack on a film, which occurred by bending each sample after the anodic oxidation treatment into a V shape. On that occasion, a pore in which the wall surface of the pore inclined against the surface of the base material, and the inclination angle of the wall surface was 850 or less was determined as "the second pore," and a pore extending approximately perpendicularly to the surface of the base material was determined as "the first pore."

<Concentrations of S and P in Porous Layer of Aluminum Member, S1(2p)/S2(2p), and Depth of Spectrum Peak of S 2p Orbital Electrons from Surface of Anodic Oxide Film>

The concentrations of S and P in the porous layer of each aluminum member, S1(2p)/S2(2p), and the depth of the spectrum peak of S 2p orbital electrons from the surface of the anodic oxide film were measured using X-ray photoelectron spectroscopy (XPS). PHI 5000 VersaProbe III manufactured by ULVAC-PHI, Inc. was used as a machine type for analysis, and measurement was performed using monochromated AlKα as an X-ray source at an ultimate vacuum pressure of $7.0\times10^{-8}$ Pa.

When the wide scan analysis for measuring the concentrations of S and P in the porous layer was conducted, the measurement was performed under an X-ray beam diameter of 100 μmϕ, an analysis area of 1400 μm×300 μm, an angle of taking out signals of 45 degrees, a path energy of 280 eV, a measurement range of 1100 eV, a step size of 1.0 eV, and a cumulative number of 20 cycles.

When the narrow scan analysis for measuring S1(2p)/S2(2p) was conducted, the measurement was performed under an X-ray beam diameter of 20 μmϕ, an analysis area of 20 μmϕ, an angle of taking out signals of 45 degrees, a step size of 0.2 eV, an energy range of 16 eV in a measurement range of 183 to 199 eV (when P was analyzed), an energy range of 20 eV in a measurement range of 155 to 175 eV (when S was analyzed), a cumulative number of 80 cycles (when P was analyzed) or 20 cycles (when S was analyzed), a beam energy of 4 KV during sputtering, a sputtering rate of 72.5 nm/min, and a sputtering time of 262 minutes. With respect to the depth of the spectrum peak of S 2p orbital electrons from the surface of the anodic oxide film, at first, the time from the start of the sputtering to the disappearance of the spectrum peak lying at a binding energy of 155 to 165 eV in the spectrum of S 2p orbital electrons was measured. Subsequently, the depth of the spectrum peak of S 2p orbital electrons from the surface of the anodic oxide film was calculated from the time to the disappearance of the spectrum peak.

From among the chemical components which were obtained by the wide scan analysis, a difference $C_S-C_P$ in the concentrations of S derived from the first acid or a salt of the first acid, and P derived from the second acid or a salt of the second acid was calculated. However, if either one or both of S and P is not detected by the analysis when the difference in the concentrations is calculated, "$C_S-C_P$" was determined as "not calculable."

TABLE 2

| | Analysis in depth direction | | | | | | | |
|---|---|---|---|---|---|---|---|---|
| | Qualitative analysis $C_S - C_P$ | Existing amount S1(2p)/S2(2p) | Depth (μm) of spectrum peak of S 2p orbital electrons from surface of anodic oxide film | Appearance characteristics: Unevenness in white color | Appearance characteristics: Hunter whiteness | First pores | Second pores | Determination |
| Example 1 | 5 | 12 | 10.0 | ◎ | 85 | Exist | Exist | ◎ |
| Example 2 | 1 | 12 | 10.0 | ◎ | 85 | Exist | Exist | ◎ |
| Example 3 | 2 | 12 | 10.0 | ◎ | 85 | Exist | Exist | ◎ |
| Example 4 | 9 | 13 | 11.0 | ◎ | 85 | Exist | Exist | ◎ |
| Example 5 | 3.6 | 14 | 11.0 | ◎ | 85 | Exist | Exist | ◎ |
| Example 6 | 0.01 | 0.4 | 4.0 | Δ | 65 | Exist | Exist | Δ |
| Example 7 | 0.02 | 2.5 | 9.0 | ◎ | 83 | Exist | Exist | ◎ |
| Example 8 | 0.1 | 15 | 10.0 | ◎ | 84 | Exist | Exist | ◎ |
| Example 9 | 3 | 40 | 11.0 | ◎ | 90 | Exist | Exist | ◎ |
| Example 10 | 4 | 52 | 11.0 | ◎ | 81 | Exist | Exist | ◎ |
| Example 11 | 10 | 180 | 35.0 | Δ | 61 | Exist | Exist | Δ |
| Example 12 | 30 | 12 | 8.0 | ◎ | 81 | Exist | Exist | ◎ |
| Example 13 | 25 | 13 | 9.0 | ◎ | 82 | Exist | Exist | ◎ |
| Example 14 | 20 | 14 | 12.0 | ◎ | 85 | Exist | Exist | ◎ |
| Example 15 | 18 | 12 | 14.0 | ◎ | 83 | Exist | Exist | ◎ |
| Example 16 | 10 | 55 | 13.0 | ◎ | 83 | Exist | Exist | ◎ |
| Example 17 | 5 | 135 | 11.0 | Δ | 69 | Exist | Exist | Δ |
| Example 18 | 1 | 15 | 5.0 | ◎ | 81 | Exist | Exist | ◎ |

TABLE 2-continued

| | Qualitative analysis $C_S - C_P$ | Analysis in depth direction: Existing amount S1(2p)/S2(2p) | Depth (μm) of spectrum peak of S 2p orbital electrons from surface of anodic oxide film | Appearance characteristics: Unevenness in white color | Hunter whiteness | First pores | Second pores | Determination |
|---|---|---|---|---|---|---|---|---|
| Example 19 | 10 | 12 | 11.0 | ◎ | 88 | Exist | Exist | ◎ |
| Example 20 | 20 | 11 | 10.0 | ◎ | 84 | Exist | Exist | ◎ |
| Example 21 | 5 | 10 | 10.0 | ◎ | 82 | Exist | Exist | ◎ |
| Example 22 | 0.5 | 7 | 3.0 | ○ | 72 | Exist | Exist | ○ |
| Example 23 | 1 | 10 | 5.0 | ◎ | 81 | Exist | Exist | ◎ |
| Example 24 | 7 | 13 | 29.0 | ◎ | 88 | Exist | Exist | ◎ |
| Example 25 | 3 | 20 | 44.0 | ◎ | 86 | Exist | Exist | ◎ |
| Example 26 | 2 | 100 | 70.0 | ◎ | 82 | Exist | Exist | ◎ |
| Example 27 | 14 | 11 | 11.0 | ◎ | 84 | Exist | Exist | ◎ |
| Example 28 | 4.8 | 1.5 | 5.0 | ◎ | 81 | Exist | Exist | ◎ |
| Example 29 | 5 | 8 | 11.0 | ◎ | 83 | Exist | Exist | ◎ |
| Example 30 | 7 | 25 | 24.0 | ◎ | 89 | Exist | Exist | ◎ |
| Example 31 | 9 | 100 | 90.0 | ○ | 76 | Exist | Exist | ○ |
| Example 32 | 10 | 150 | 99.0 | Δ | 60 | Exist | Exist | Δ |
| Comparative Example 1 | Not calculable | Undetectable | Not calculable | x | 59 | Not exist | Not exist | X |
| Comparative Example 2 | Not calculable | Undetectable | Not calculable | x | 54 | Not exist | Not exist | X |
| Comparative Example 3 | Not calculable | 150 | 20 | ◎ | 55 | Exist | Not exist | X |

Figure 3:
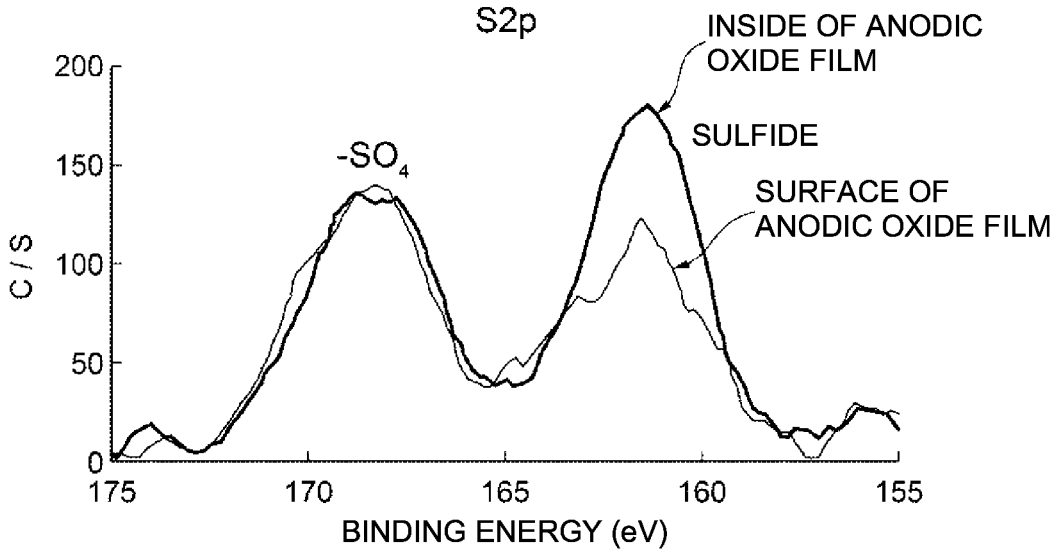
FIG. 3 is a graph showing results of analyzing the existing amount of 2p orbital electrons of S from the surface of an aluminum member in Example 3 in the depth direction by narrow scan analysis (X-ray photoelectron spectroscopy/XPS).

FIG. 3 is a graph showing results of analyzing S 2p orbital electrons in the depth direction from the surface of the aluminum member in Examples 3 by the narrow scan analysis (X-ray photoelectron spectroscopy/XPS). Among the peaks indicating a sulfide, each of the spectrum peak value at the surface (the region S2 having a depth of 0 to 500 nm from the surface) of the porous layer and the spectrum peak value in the inside (the region S1 having a depth greater than 500 nm) of the porous layer was measured to calculate S1(2p)/S2(2p).

In Examples 1 to 32, aluminum members each including a base material containing an aluminum alloy and an anodic oxide film having a thickness of 100 μm or less on the surface of the base material were manufactured. Each of the anodic oxide films of Examples 1 to 32 had a barrier layer formed on the surface of the base material and a porous layer formed on the barrier layer, and the porous layer had the first and the second pores. In addition, it was confirmed that each porous layer contained S (sulfur) and P (phosphorus) by the elemental analysis using the wide scan analysis of the aluminum members of Examples 1 to 32, and the concentration of S, $C_S$, and the concentration of P, $C_P$, satisfied the relationship of $C_S-C_P>0$ (that is, $C_S>C_P$) in the porous layer over the depth direction from the surface of the anodic oxide film toward the base material. Further, in each of Examples 1 to 32, by performing the anodic oxidation treatment on the prepared base material containing an aluminum alloy in the electrolytic solution containing the first acid containing S or a salt of the first acid, and the second acid selected from the group consisting of diphosphoric acid, triphosphoric acid, and polyphosphoric acid, or a salt of the second acid, the aluminum member of the present disclosure could be manufactured. Therefore, in the aluminum members of Examples 1 to 32, S and P existed in the porous layers, and the unevenness in white color was "Δ", "○," or "◎," and the aluminum members had high hunter whiteness, and accordingly the aluminum members having excellent appearance characteristics could be obtained.

In contrast, in Comparative Examples 1, an anodic oxidation treatment was not performed on the base material in an electrolytic solution of sulfuric acid and diphosphoric acid, and therefore a porous layer containing S and P in the film was not formed, so that the concentration of S, $C_S$, and the concentration of P, $C_P$, could not be calculated. In addition, an anodic oxide film was not formed, and therefore the unevenness in white color was "x," and the Hunter whiteness was low.

Similarly, in Comparative Examples 2, the electrolytic solution did not contain sulfuric acid (the first acid or a salt of the first acid), and therefore a porous layer containing both of S and P in the film was not formed, so that the concentration of S, $C_S$, and the concentration of P, $C_P$, could not be calculated. In addition, a lot of unevenness in white color existed in the formed anodic oxide film, and therefore the unevenness in white color was "x," and the Hunter whiteness was low.

In Comparative Examples 3, the electrolytic solution did not contain diphosphoric acid (the second acid or a salt of the second acid), and therefore only S was contained in the film, so that a porous film containing both of S and P was not formed. Therefore, the second pores were not formed in the porous layer, resulting in low Hunter whiteness even though the unevenness in white color was "◎."

What is claimed is:

1. An aluminum member comprising:

a base material containing aluminum or an aluminum alloy; and an anodic oxide film having a barrier layer on a surface of the base material and a porous layer on the barrier layer, wherein the anodic oxide film has a thickness of 100 μm or less, the porous layer contains S and P, and a concentration of S, $C_S$, and a concentration of P, $C_P$, in the porous layer, measured by X-ray photoelectron spectroscopy, satisfy $C_S>C_P$, first pores extending perpendicularly to a surface of the barrier layer lie on a barrier layer side of the porous layer, second pores lie on a surface side of the porous layer and extend in a thickness direction of the porous layer in such a way as to branch radially toward a surface of the porous layer, and the second pores communicate with the first pores.

2. The aluminum member according to claim 1, wherein when in a depth direction from a surface of the anodic oxide film toward the base material, a region having a depth greater than 500 nm from a surface of the porous layer is defined as S1, and a region having a depth of 500 nm or less from the surface of the porous layer is defined as S2, an existing amount of a sulfide based on 2p orbital electrons in the region S1 measured by X-ray photoelectron spectroscopy, S1(2p), and an existing amount of the sulfid based on 2p orbital electrons in the region S2 measured by X-ray photoelectron spectroscopy, S2(2p), satisfy a relationship of $$S1(2p)/S2(2p)=0.5 \text{ to } 100.$$

3. The aluminum member according to claim 1, wherein a peak of a spectrum based on 2p orbital electrons of S in a binding energy of 155 to 165 eV measured by X-ray photoelectron spectroscopy, exists in the porous layer in a range of a depth of 0.50 to 100 μm from a surface of the porous layer in a depth direction from a surface of the anodic oxide film toward the base material.

4. The aluminum member according to claim 1, wherein the porous layer comprises a pore having a wall surface that makes an acute angle with the surface of the base material.

5. The aluminum member according to claim 1, wherein a Hunter whiteness measured from a surface side of the anodic oxide film is 60 to 90.

6. A method of manufacturing the aluminum member according to claim 1, comprising:

preparing a base material containing aluminum or an aluminum alloy; and performing an anodic oxidation treatment on the base material in an electrolytic solution containing (a) a first acid containing S or a salt of the first acid, and (b) at least one second acid selected from the group consisting of diphosphoric acid, triphosphoric acid, and polyphosphoric acid, or a salt of the second acid.

7. The method of manufacturing the aluminum member according to claim 6, wherein in performing the anodic oxidation treatment, a concentration of the first acid or the salt of the first acid in the electrolytic solution is 0.01 to 2.0 $mol \cdot dm^{-3}$, and a concentration of the second acid or the salt of the second acid in the electrolytic solution is 0.01 to 5.0 $mol \cdot dm^{-3}$.

8. The method of manufacturing the aluminum member according to claim 6, wherein in performing the anodic oxidation treatment, the anodic oxidation treatment is performed under conditions of a current density of 5 to 30 $mA \cdot cm^{-2}$ and an electrolysis time of 10 to 600 minutes.

* * * * *